US011221149B2

(12) United States Patent
Laing

(10) Patent No.: US 11,221,149 B2
(45) Date of Patent: Jan. 11, 2022

(54) PUMP DEVICE, INDUSTRIAL WATER SYSTEM, METHOD FOR OPERATING AN INDUSTRIAL WATER SYSTEM, AND SELF-TEACHING METHOD FOR A DELIVERY PUMP IN AN INDUSTRIAL WATER SYSTEM

(71) Applicant: Xylem IP Management S.à r.l., Senningerberg (LU)

(72) Inventor: Oliver Laing, Herrenberg (DE)

(73) Assignee: Xylem IP Management S. à r.l., Luxembourg (LU)

( * ) Notice: Subject to any disclaimer, the term of this patent is extended or adjusted under 35 U.S.C. 154(b) by 583 days.

(21) Appl. No.: 15/776,560

(22) PCT Filed: Nov. 14, 2016

(86) PCT No.: PCT/EP2016/077579
§ 371 (c)(1),
(2) Date: May 16, 2018

(87) PCT Pub. No.: WO2017/085015
PCT Pub. Date: May 26, 2017

(65) Prior Publication Data

US 2018/0347831 A1 Dec. 6, 2018

(30) Foreign Application Priority Data

Nov. 17, 2015 (DE) ..... 102015119883.5

(51) Int. Cl.
*F24D 19/10* (2006.01)
*F04D 15/00* (2006.01)
(Continued)

(52) U.S. Cl.
CPC ..... *F24D 19/1051* (2013.01); *F04D 13/06* (2013.01); *F04D 15/0005* (2013.01);
(Continued)

(58) Field of Classification Search
CPC .. F04D 13/06; F04D 15/0005; F04D 15/0011; F04D 15/0083; F04D 15/0209; F24D 17/0078; F24D 19/1051
(Continued)

(56) References Cited

U.S. PATENT DOCUMENTS 5,143,049 A 9/1992 Laing et al.
7,073,528 B2 * 7/2006 Kempf ..... E03B 7/045 122/13.3
(Continued)

FOREIGN PATENT DOCUMENTS

DE 1192002 B 4/1965
DE 29619824 U1 2/1997
(Continued)

OTHER PUBLICATIONS

International Search Report and Written Opinion for International Application No. PCT/EP2016/077579, dated Feb. 17, 2017, 11 pages.

*Primary Examiner* — Steven B McAllister
*Assistant Examiner* — Benjamin W Johnson
(74) *Attorney, Agent, or Firm* — RatnerPrestia

(57) ABSTRACT

A pump device is proposed for arrangement on a recirculation line of an industrial water system including a feed pump, a check valve and a bypass line for the check valve. The bypass line is arranged in parallel to the check valve and wherein a combination of the check valve and bypass line is arranged in series to the feed pump.

18 Claims, 6 Drawing Sheets

(51) Int. Cl.
*F04D 15/02* (2006.01)
*F24D 17/00* (2006.01)
*F04D 13/06* (2006.01)

(52) U.S. Cl.
CPC ..... *F04D 15/0011* (2013.01); *F04D 15/0083* (2013.01); *F04D 15/0209* (2013.01); *F24D 17/0078* (2013.01)

(58) Field of Classification Search
USPC ..... 122/13.3
See application file for complete search history.

(56) References Cited

U.S. PATENT DOCUMENTS

| | | | | |
|---|---|---|---|---|
| 7,128,090 | B1 * | 10/2006 | Muroi | F16K 47/02 137/513.7 |
| 8,714,934 | B2 | 5/2014 | Laing et al. | |
| 2006/0230772 | A1 | 10/2006 | Wacknov et al. | |
| 2009/0145490 | A1 * | 6/2009 | Kershisnik | E03B 7/04 137/334 |
| 2016/0169220 | A1 | 6/2016 | Laing et al. | |

FOREIGN PATENT DOCUMENTS

| | | | |
|---|---|---|---|
| DE | 29900274 | U1 | 4/1999 |
| DE | 10106106 | A1 | 8/2002 |
| DE | 10128444 | A1 | 12/2002 |
| DE | 102006054729 | B3 | 10/2007 |
| DE | 102007007414 | B3 | 3/2008 |
| DE | 102007054313 | A1 | 5/2009 |
| DE | 202012010328 | U1 | 11/2012 |
| DE | 102013109134 | A1 | 2/2015 |

* cited by examiner

PUMP DEVICE, INDUSTRIAL WATER SYSTEM, METHOD FOR OPERATING AN INDUSTRIAL WATER SYSTEM, AND SELF-TEACHING METHOD FOR A DELIVERY PUMP IN AN INDUSTRIAL WATER SYSTEM

CROSS-REFERENCE TO RELATED APPLICATIONS

This patent application is a U.S. National Phase Patent Application of PCT Application No.: PCT/EP2016/077579, filed Nov. 14, 2016, which claims priority to German Patent Application No. 10 2015 119 883.5, filed Nov. 17, 2015, each of which is incorporated by reference herein in its entirety.

FIELD OF THE INVENTION

The invention relates to a pump device for arrangement on a recirculation line of an industrial water system.

The invention further relates to an industrial water system comprising a hot water provision device, a hot water pipe which is connected to the hot water provision device and in which at least one tapping point is arranged and a recirculation line which is connected to the hot water pipe and leads to the hot water provision device.

The invention further relates to a method for the operation of an industrial water system comprising a hot water provision device, a hot water pipe having at least one tapping point and a recirculation line.

The invention further relates to a self-learning method for a feed pump of an industrial water system.

BACKGROUND OF THE INVENTION

A circulation control is known from DE 10 2006 054 729 B3 which comprises a sensor to detect hot water tapping processes and trigger the start of a circulation pump as a result on request. A microcontroller or microcomputer is provided to process the signal and control the circulation pump. Cyclically circumferential habit memories and triggering starts of the circulation pump are provided in the event that a threshold level is exceeded by the saved likelihood of need. The saved value of the currently applicable time interval is the output value of a low-pass function, the input value of which is formed from the cyclically scanned test results of tapping processes in the relevant interval and the time constant of which is variable and in principle different for tapping processes that are detected or not detected. Recognised tapping processes are temporarily stored in a further memory with a cyclical structure and are only processed during the next day period to determine the precise content of the habit memory. If the sensor used to detect tapping processes is a temperature sensor, whenever the riser pipe has been warmed up its cooling speed is compared with a reference value to recognise a tapping process under these conditions.

A circulation apparatus is known from DE 10 2007 007 414 B3.

A trace heating control device for central hot water supply in buildings is known from DE 20 2012 010 328 U1 and has at least one sensor to detect hot water tapping processes.

An arrangement and a method for the requirement-dependent automatic control of hot water circulation pumps is known from DE 101 28 444 B4.

An arrangement and the method for the requirements-based activation of a hot water cycle is known from DE 101 06 106 A1.

A circulating pump for a pumping medium is known from DE 10 2007 054 313 A1 and comprises an electric motor which is electronically commutated and has a rotor, a stator and a motor circuit and a paddle which is non-rotatably connected to the rotor. The electronic motor has an evaluation direction, by means of which the number of rotations of the rotor and/or the power consumption of the electronic motor can be used to determine the quantity of pumping medium that flows through the circulating pump. At least one signal output is provided, at which the circulating pump can provide a throughflow quantity signal and/or a throughflow quantity-dependent switch signal.

A method for the determination of a throughflow quantity of a liquid system is known from DE 10 2013 109 134 A1.

SUMMARY OF THE INVENTION

The object of the invention is to provide a pump device of the type mentioned at the outset by means of which an industrial water system can be operated in a simple and convenient manner.

This object is achieved according to the invention by the provision of a feed pump, a check valve and a bypass line for the check valve, wherein the bypass line is arranged in parallel to the check valve and wherein a combination of the check valve and the bypass line is arranged in series with the feed pump.

The feed pump can be used to circulate hot water in a recirculation process. When water is run from a tap, the check valve prevents hot water from a hot water provision device flowing through the feed pump at high speed against the direction of flow of the feed pump.

The bypass line ensures that a small quantity of hot water can nevertheless flow back into the feed pump. This can lead to a temperature change and in particular to a relatively abrupt change in temperature, which can be detected. This change in temperature is an indication of water tapping.

"On-board means" in the pump device according to the invention can be used to detect water tapping in the industrial water system regardless of whether the feed pump is in operation or not.

The pump device according to the invention can be used to determine a user pattern, which in turn can be used in a self-learning method for the control/setting/adjustment of the operation of the feed pump. The industrial water system can be operated conveniently as a result. Using a learned user pattern, significant cooling of hot water in a hot water pipe of the industrial water system can be prevented through recirculation at times at which hot water is usually tapped.

No additional sensor needs to be provided outside of the pump device and in particular outside of the feed pump for a self-learning method of this type. This means there are no costs for cabling or the coupling of signals.

In particular, the pump device has a first connection which is (directly) connected to the combination of a check valve and bypass line for fluid purposes, and which first connection is used to connect the pump device to a hot water provision device. In particular, in a backflow industrial water from the hot water provision device is connected to the pump device via the first connection.

The pump device further has a second connection which is (directly) connected to the feed pump for fluid purposes, wherein water as the pumping medium flows from the second connection to the first connection when the feed pump of the pump device is operated. In "recirculation operation" of the feed pump, said pump moves this water from the recirculation line, which is connected to the second connection, into the hot water provision device, which is connected to the first connection.

It is favourable if the check valve is arranged and designed such that it closes on water tapping on a hot water line on which the recirculation line is arranged. This prevents the "extensive" mixing of water from the hot water provision device and water from the recirculation device. Water from the hot water provision device can then not flow against the direction of flow of the feed pump at high speed. The pressure of hot water provision compared to the pressure difference of the pump device is generally sufficient to close the check valve. The check valve advantageously ensures closure both when the pump is operating and when the feed pump is not operating.

It is favourable if the bypass line is arranged and designed such that there is a throughput of pumping medium through it which consists of a maximum of 15% of the throughput of pumping medium through the pump device when the check valve is open and the feed pump is in operation. This means that the "disruption" caused by the open bypass line is kept to a minimum.

In particular, it is favourable if the bypass line has a hydraulic cross-sectional area which is in the range of 5% to 15% of the hydraulic cross-sectional area of the recirculation line on which the pump device is arranged. The boundary at the bottom prevents the lime deposits that occur over the normal period of operation and deposits of particles of dirt clogging the bypass line and the upper boundary ensures that the impact of the bypass line on normal recirculation operation is kept to a minimum.

It is particularly advantageous if the pump device comprises a sensor device and an evaluation device that is connected to the sensor device for signal purposes, by means of which it is possible to detect when water is tapped out of a hot water line to which the recirculation line is connected. The evaluation device can then be used to determine when these tapping processes occur. This in turn enables the determination of a user pattern based on time.

It is advantageous if the sensor device is integrated into the feed pump and in particular is arranged inside a housing of the feed pump. This results in a minimal level of complexity in the circuit and no lines have to be run to the industrial water system for a sensor device.

For the same reasons it is favourable if the evaluation device is integrated into the feed pump and in particular is arranged inside a housing of the feed pump and in particular on a support, which is a support for a motor circuit of an electric motor of the feed pump or is connected to a support of this type. This results in optimised integration. In particular, the evaluation device part of the motor circuit is identical to this.

It is favourable if the sensor device is arranged and designed and the evaluation device is designed such that the water tapping can be detected both when the feed pump is running and when the feed pump is not running. This enables a user pattern to be determined with certainty. This in turn results in safe and convenient operation.

In particular, the sensor device is arranged and designed and the evaluation device is designed such that when the feed pump is running the water tapping can be detected from a change in the quantity of pumping medium flowing through the feed pump and/or from the absolute throughflow quantity. A throughflow quantity and in particular a change in the throughflow quantity can easily be determined. As a result, water tapping can easily be detected when the feed pump is operating.

In particular, the sensor device comprises a sensor to determine the number of rotations of a rotor of an electric motor of the feed pump and/or a sensor to determine the power consumption of the electric motor, and the evaluation device determines the throughflow quantity from the number of rotations and the power consumption of the electric motor. For example, the number of rotations is specified and the power consumption is measured or the power consumption is specified and the number of rotations is measured. The known link between the throughflow quantity and the number of rotations and power consumption means that these can then be determined. In particular, a change can easily be identified. The evaluation device monitors the throughflow quantity constantly in order to detect tapping in good time.

It is particularly advantageous if the sensor device has at least one temperature sensor which is in particular arranged inside the feed pump. The temperature sensor can be used to detect significant changes in temperature which are due to water flowing back from a hot water provision device into the feed pump. As a result, water tapping can be identified even if the feed pump is not in operation. No sensor (such as a temperature sensor) is provided outside of the pump device in order for this to be able to be detected.

In particular, the evaluation device monitors the temperature signals provided by the at least one temperature sensor and provides a detection signal in particular in the event of a (specific) temperature change, which indicates the flow of water back from the hot water provision device through the bypass line into the feed pump, particularly when the feed pump is not in operation. This specific temperature change is in particular a rapid temperature change caused by water flowing from the hot water provision device through the bypass line and into the feed pump.

It can be provided that the evaluation device generates a signal to switch on the feed pump when the detection signal is generated. In this way it is possible to verify that water tapping is actually being carried out by determining the throughflow quantity when the feed pump is running. The feed pump can also continue to be operated until there is no further water tapping and in this way the duration of the water tapping can be determined.

It is particularly advantageous for a self-learning device to be provided which provides control signals for the operation of the feed pump on the basis of a user pattern determined using the sensor device and the evaluation device. The evaluation device can provide data on water tapping. In principle, these data can be determined in a time-bound manner. The self-learning device can then identify a user pattern. Through this in turn the feed pump can be operated such that it enables optimal convenience in terms of the operation of an industrial water system. For example, recirculation is carried out for a certain amount of time before expected tapping in order to "remove" water that has cooled significantly from a hot water line.

In an exemplary embodiment the self-learning device is connected to the evaluation device. For example, the self-learning device and the evaluation device are arranged in the same microcontroller in which a motor circuit of an electric motor of the feed pump is arranged.

It is particularly advantageous if the self-learning device has a timing element which determines a time of water tapping and saves these times accordingly, wherein control and/or setting and/or adjustment of the operation of the feed pump occurs based on the times saved. A time-bound user pattern can be determined in this way. Time control of the operation of the feed pump can be implemented as a result.

It is favourable if the starting up of the feed pump occurs at a time interval and in particular at a specific time interval (for example 15 minutes) before the saved times and/or if the end of the operation of the feed pump occurs at a time interval and in particular at a specific time interval (for example 15 minutes) after the saved times. This enables convenient operation.

According to the invention, an industrial water system of the type mentioned at the outset is provided in which a pump device according to the invention is arranged on the recirculation line.

The corresponding industrial water system has the advantages already explained in connection with the pump device according to the invention.

A method for the operation of an industrial water system of the type mentioned at the outset is also provided, wherein a pump device according to the invention is arranged on the recirculation line. A tapping of water from the hot water line is detected when the feed pump is running by means of a determination of the throughflow of pumping medium through the feed pump and a tapping of water from the hot water line when the feed pump is not running is detected from measured temperature changes on the feed pump.

The method according to the invention can be used to determine a user pattern without an external sensor having to be provided.

The method according to the invention has the advantages already explained in connection with the pump device according to the invention.

In particular, temperature changes in the feed pump which are used to detect a tapping of water from the hot water line and in particular are measured inside the feed pump, caused by water flowing from the hot water provision device through the bypass line and into the feed pump. It is possible to determine whether water tapping is occurring even if the feed pump is not operating.

In particular, the feed pump is started if it is not currently running when temperature changes are detected. In this way, for example, the detection of a throughflow quantity can be used to verify whether tapping occurred.

According to the invention a self-learning method of the type mentioned at the outset is further provided in which a user pattern with regard to water tapping is determined using the method according to the invention for the operation of an industrial water system and based on the pattern determined pump operation of the feed pump can be controlled and/or set and/or adjusted.

A user pattern can be safely and conveniently identified using the self-learning method according to the invention, which in turn can be used to control the operation of the industrial water system. This enables convenient operation.

In particular, when determining the pattern times of water tapping are saved and pump operation is initiated at a point before a corresponding saved time and/or pump operation is ended at a point after a corresponding saved time. This enables convenient operation.

It is possible to provide for a pattern that has been determined to have a finite duration and in particular following a lack of use of the pattern for a specific period of time it is deactivated for operation of the feed pump. This [prevents] a rare usage pattern being used too often.

For example, the pattern is a percentage of n hours and an overlapping percentage of m days, wherein n=24 and m=7 in particular. This means a daily routine can overlap with a weekly routine.

BRIEF DESCRIPTION OF THE DRAWING FIGURES

The following description of preferred embodiments explains the invention in greater detail in combination with the drawings. In the drawings.

DETAILED DESCRIPTION OF THE INVENTION

Figure 1:
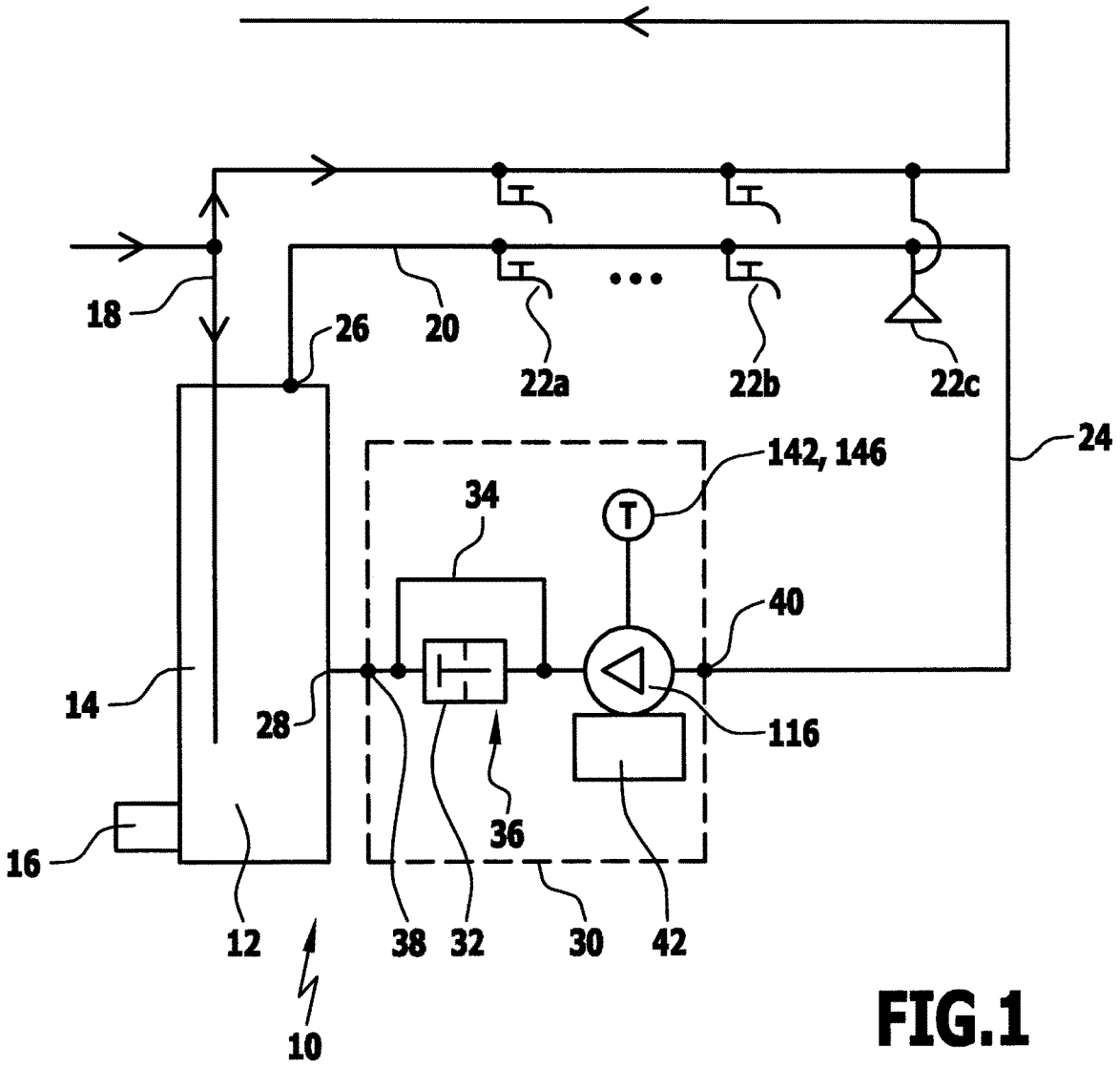
FIG. 1 shows a schematic representation of an exemplary embodiment of an industrial water system with a schematic representation of an exemplary embodiment of a pump device according to the invention.

An exemplary embodiment of the industrial water system according to the invention shown in FIG. 1 and schematically designated 10 comprises a hot water provision device 12. This has in particular a hot water tank 14 which stores hot water.

A boiler 16 is for example allocated to the hot water tank 14.

The hot water provision device 12 has a feed-in device 18 for fresh water (cold water), by means of which fresh water that can be heated is fed in.

A hot water line 20 is connected to the hot water provision device 12, by means of which hot water can be taken out of the hot water tank 14.

Tapping points 22*a*, 22*b*, 22*c* are connected to the hot water line 20. The tapping points comprise for example one or more taps and one or more shower heads. Hot water can be obtained from these.

A recirculation line 24 is connected to the hot water line 20 after the last tapping point (labelled 22*c* in FIG. 1). The recirculation line is a continuation of the hot water line 20 after the final tapping point 22*c*. The recirculation line 24 leads to the hot water provision device 12 and is therefore connected to the hot water tank 14.

Through the recirculation line 24 hot water can circulate between a first connection 26 and a second connection 28 of the hot water provision device 12 in a non-tapping operation of tapping points 22*a*, etc. The hot water line 20 is connected to the hot water provision device 12 via the first connection 26. The recirculation line 24 is connected to the hot water provision device 12 via the second connection 28.

A specific temperature level can be maintained for hot water in the hot water line 20 by means of a recirculation of hot water between the first connection 26 and the second connection 28. This prevents too great a cooling of hot water in the hot water line 20 and no water in particular that has cooled too greatly in the line flows out when a tapping point 22*a* is tapped.

A pump device 30 is provided to pump hot water into the recirculation line 24. This pump device 30 is arranged on the recirculation line 24. The pump device 30 pumps pumping medium, namely hot water, between the first connection 26 and the second connection 28.

The pump device 30 comprises a feed pump 116.

The pump device 30 further comprises a check valve 32 and a bypass line 34. The bypass line 34 is arranged in parallel to the check valve 32. Through it, the check valve can be "bridged", in other words bypassed. The bypass line 34 can consist of one pipe or several pipes.

The bypass line 34 and the check valve 32 form a combination 36. This combination 36 is arranged in series with the feed pump 116.

The pump device 30 comprises a first connection 38 and a second connection 40. The combination 36 is connected directly to the hot water provision device 12 for fluid purposes via the first connection 38 and therefore connected to its second connection 28 for fluid purposes. The feed pump 116 is connected to the recirculation line 24 via the second connection 40. When the pump device 30 is operating, pumping medium (water) flows from the second connection 40 to the first connection 38 in the water tank 14.

An exemplary embodiment of a feed pump 116 (circulating pump) is for example known from DE 10 2007 054 313 A1 or US 2009/0121034. Reference is expressly made to the full content of these documents.

Pump 116 (FIG. 2) comprises an electric motor 120 with a stator 122 and a rotor 124.

The electric motor 120 has a motor housing 126 in which the stator 122 and the rotor 124 are arranged.

Figure 2:
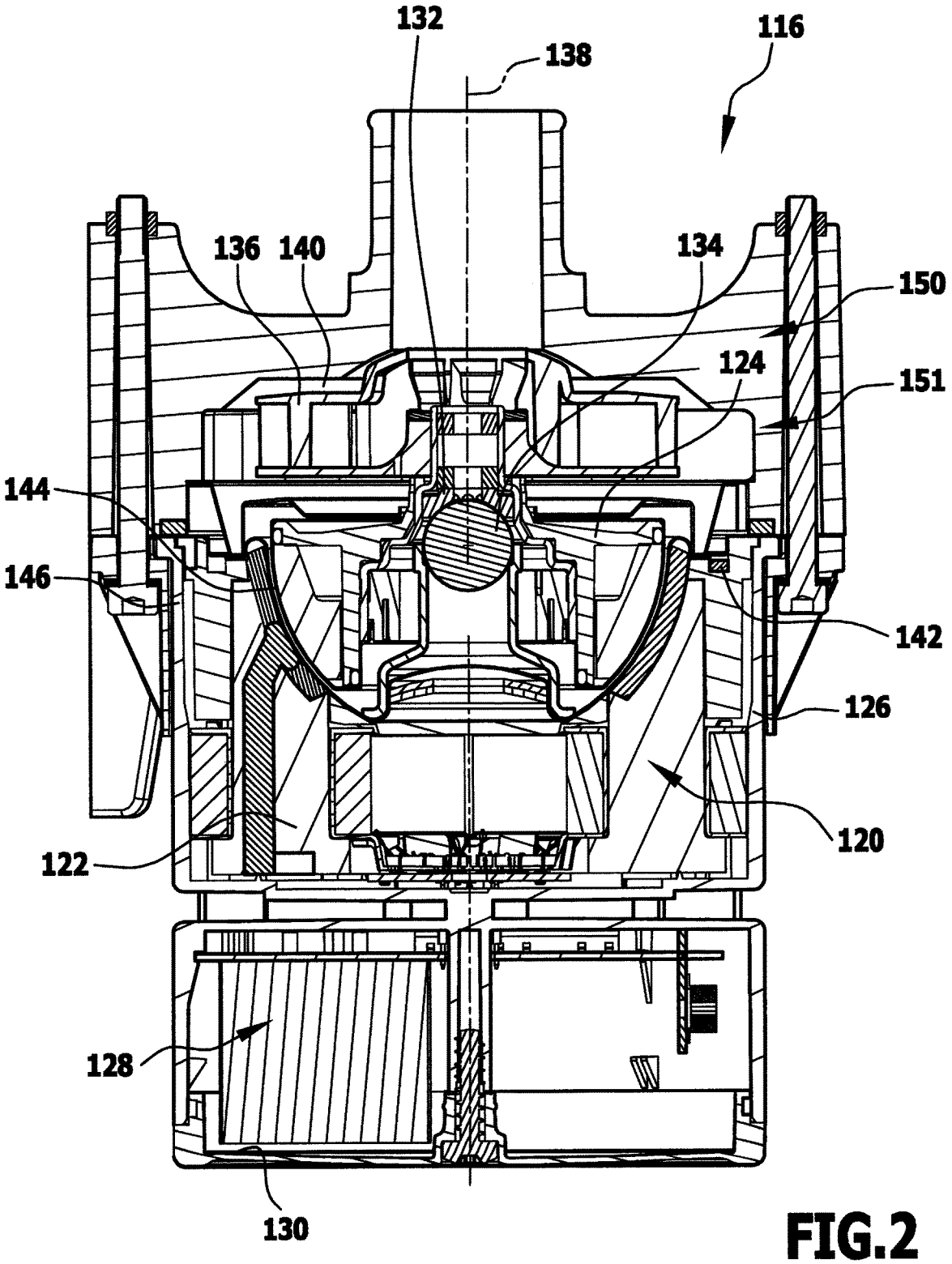
FIG. 2 shows a cross-sectional view of an exemplary embodiment of a feed pump of the pump device according to FIG. 1.

The electric motor 120 further has a motor circuit 128. The motor circuit 128 is arranged in a circuit housing 130. The circuit housing 130 can be separate from the motor housing 126 or be formed by the motor housing 126, as shown in FIG. 2.

The rotor 124 is mounted on a convex bearing body 134 by means of a bearing shell 132, which bearing body is in particular formed as a bearing ball made of a ceramic material. A spherical bearing is formed from the bearing body 134 and the bearing shell 132.

An impeller 136 is non-rotatably connected to the rotor 124. The impeller 136 rotates about a rotational axis 138 in a pumping chamber 140. Pumping medium can flow through the pumping chamber 140, wherein the flow is driven by the impeller 136 during pumping operation.

The feed pump 116 comprises a temperature sensor 142.

The temperature sensor 142 is arranged and designed such that a temperature of pumping medium in the pumping chamber 140 can be determined using said sensor.

The temperature sensor 142 should ideally be located outside of the pumping chamber 140. This means the temperature sensor 142 can be simpler in design as it does not come into contact with liquid.

The pumping chamber 140 is limited by a wall 144. In an exemplary embodiment the temperature sensor 142 is outside of the pumping chamber 140 on the wall 144. It can be placed, for example, directly on an outside of the wall 144 or at a small distance from this. It is in particular in thermal contact with the wall 144.

There is preferably a provision for the temperature sensor to be positioned on the motor housing 126 as indicated in FIG. 2 by the reference number 146, where it is in thermal contact with the pumping chamber 140. The temperature sensor 142 may be located in the position shown in FIG. 2 for temperature sensor 142, or the temperature sensor 142 may be located in the position indicated by the temperature sensor provision 146.

The pump device 30 has an evaluation device 42 which is in particular integrated into the feed pump 116. The temperature sensor 142 provides its temperature signals to the evaluation device 42. The evaluation device 42 is for example integrated into the motor circuit 128.

The feed pump 116 has a housing 150. The housing 150 is in particular thermally insulated. The impeller 36 is arranged inside the housing 150. The electric motor 20 is at least in part arranged inside the housing 150. The temperature sensor 142 is arranged inside the housing 150.

In an exemplary embodiment the housing 150 has a pump housing 151 as the first part of the housing and the motor housing 126 as the second part of the housing. The motor housing 126 is positioned on the pump housing 151. The impeller 136 is positioned in the pump housing 151. The temperature sensor 142 is positioned in the housing 150, in particular in the motor housing 126 or for example outside on the pump housing 151.

For the simple disassembly of the electric motor 120 from the pump housing 151, it is advantageous for the temperature sensor 142 to be located in the position indicated by the temperature sensor provision 146. This then means that no cable connections for the temperature sensor need to run into the pump housing 151.

In an embodiment a temperature control device is allocated to the temperature sensor (for example the temperature sensor 142). The temperature control device ensures that defined temperature conditions are present in the area surrounding the temperature sensor 142. As a result, time-bound temperature changes can be allocated directly to temperature changes in the pumping medium in the pumping chamber 140.

In an embodiment the temperature control device comprises a temperature control chamber. This has a housing in particular made of a thermally insulating material. The temperature sensor 142 is then arranged in the housing and is in thermal contact with the pumping chamber 140. For example, it is arranged directly on the wall 144 or a heat conduction connection is provided between the wall 144 and the temperature sensor 142 and the housing.

In an embodiment the temperature control device comprises at least one heating element and at least one resistance heating element which is arranged in the temperature control chamber. Through the corresponding application of electricity to the heating element a defined temperature can be set in the temperature control chamber and therefore in the area surrounding the temperature sensor 142.

Figure 7:
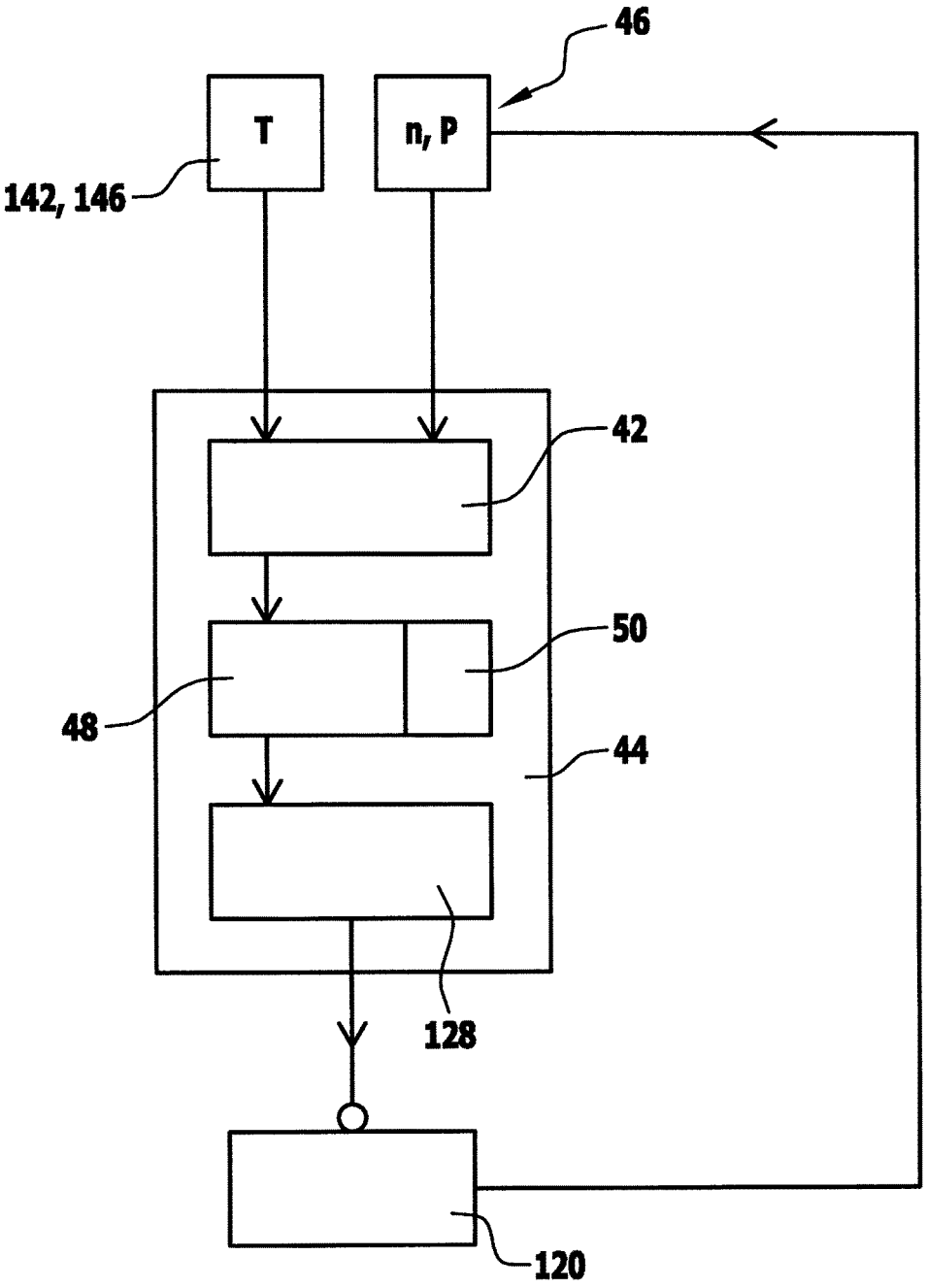
FIG. 7 shows a schematic representation of an evaluation device of the pump device according to FIG. 1.

In an exemplary embodiment the evaluation device 42 is arranged on a support 44 (FIG. 7). The support 44 is in particular positioned in the circuit housing 130.

The motor circuit 128 is arranged on the same support 44 or on a support connected to the support 44, which motor circuit controls the electric motor 120. The temperature sensor 142 is connected to the evaluation device 42 for signal purposes, in other words the relevant temperature signals are provided to the evaluation device 42 which monitors the temperature signals.

As explained below in greater detail, a sensor device is formed by the temperature sensor 142, by means of which sensor device water tapping on the hot water line 20 can be detected when the feed pump 116 is not running.

A sensor device 46 is further provided (FIG. 7) which determines the number of rotations n of the rotor 124 of the electric motor 120 and/or the power consumption P of the electric motor 120. This is explained in greater detail below.

The sensor device 46 is in particular integrated into the electric motor 120 and for example integrated into the motor circuit 128.

The sensor device 46 is also connected to the evaluation device 42 for signal purposes.

A self-learning device 48 is further positioned on the support 44. The evaluation device 42 evaluates corresponding sensor data from the sensor device 46 and the temperature sensor 142.

The self-learning device 48 can, as described below in greater detail, generate a user pattern for hot water use from the data evaluated accordingly, which in particular is determined with a link to the time. In order to do this, the self-learning device 48 comprises a timing element 50, by means of which the times of hot water tapping on the hot water line 20 can be determined.

The self-learning device 48 in turn generates data for the motor circuit 128 to control the electric motor 120 and therefore, the feed pump 116.

This is explained in greater detail below.

The self-learning device 48 can be integrated into the motor circuit 128.

For example, a microcontroller of the motor circuit 128 also comprises the evaluation device 42 and the self-learning device 48.

In the combination 36, the bypass line preferably has a hydraulic cross-section which is smaller than the hydraulic cross-section of the recirculation line 24. In particular, the hydraulic cross-section of the bypass line 34 is in the range from 5% to 15% of the hydraulic cross-section of the recirculation line 24. In an exemplary embodiment the hydraulic cross-section of the bypass line 34 is approximately 10% of the hydraulic cross-section of the recirculation line 24.

The cross-section of the bypass line 34 is selected to be sufficiently great for there to be no blockage as a result of lime or dirt particles and on the other hand is sufficiently small that on tapping the quantity of water that flows through the bypass line 34 to a tapping point is small enough that the water temperature at the tapping point is not noticeably impacted. (The corresponding quantity of water flowing back may also consist of cold water.)

The check valve 32 is arranged and designed such that the feed pump 116 is protected against a backflow of water (hot water) from the hot water provision device 12 and water from the water tank 14 can mix with water from the hot water line 20 in the recirculation line 24.

The bypass line 34, however, enables backflow to a certain extent for metrological reasons, as will be explained in greater detail below. This backflow is, however, limited and kept "small" by the diameter of the bypass line 34 being correspondingly selected to be small.

In particular, the design of the bypass line 34 limits the backflow for a throughflow of pumping medium, which is a maximum of 15% of a throughflow of pumping medium through the pumping device 30 in normal recirculation operation if the pumping medium is pumped from the second connection 40 to the first connection 38.

Figure 3:
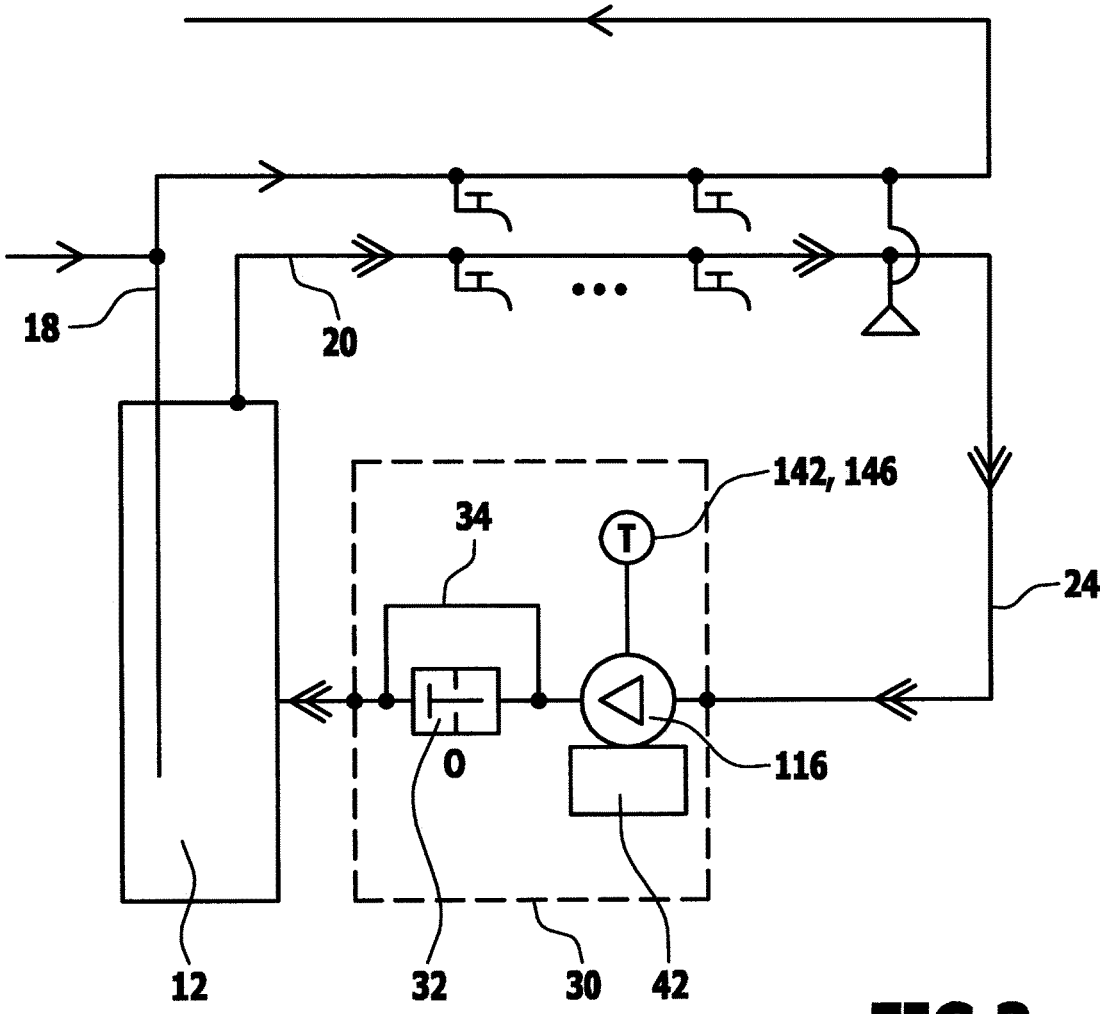
FIG. 3 shows a representation of the industrial water system according to FIG. 1, wherein the direction of flow of water is indicated in a recirculation line and an open check valve with no water tapping.

In normal operation of the industrial water system 10 without water tapping, the pump device 30 pumps a certain quantity of hot water through the hot water line 20 and the recirculation line 24. Hot water is circulated from the hot water provision device 12 through the hot water line 20, wherein the recirculation line 24, which leads to the hot water tank 14, closes the pumping cycle. The feed pump 116 ensures that the water is pumped. This "normal operation" is shown in FIG. 3. In this normal operation, the check valve 32 is open (indicated in FIG. 3 with "0"). A flow direction of the hot water is indicated with a double arrow.

In principle, the recirculation of hot water can occur constantly at times in which water tapping is expected, or it can for example occur in a timed manner.

The recirculation of hot water through the hot water line 20 and the recirculation line 24 can in particular take place depending on a certain user patter in order to enable energy-saving operation. For example, no hot water circulation is needed during long rest phases. The user pattern in turn can be determined using the evaluation device 42 and through the self-learning device 48 the motor circuit 128 can provide relevant data for the control and/or setting and/or adjustment of the operation of the feed pump 116.

In the "recirculation state" according to FIG. 3, the majority of the pumping medium which is guided through the combination 36 is guided through the open check valve 32. A small part of the total throughput can flow through the bypass line 34, wherein this part is in particular a maximum of 15% as explained above.

Figure 4:
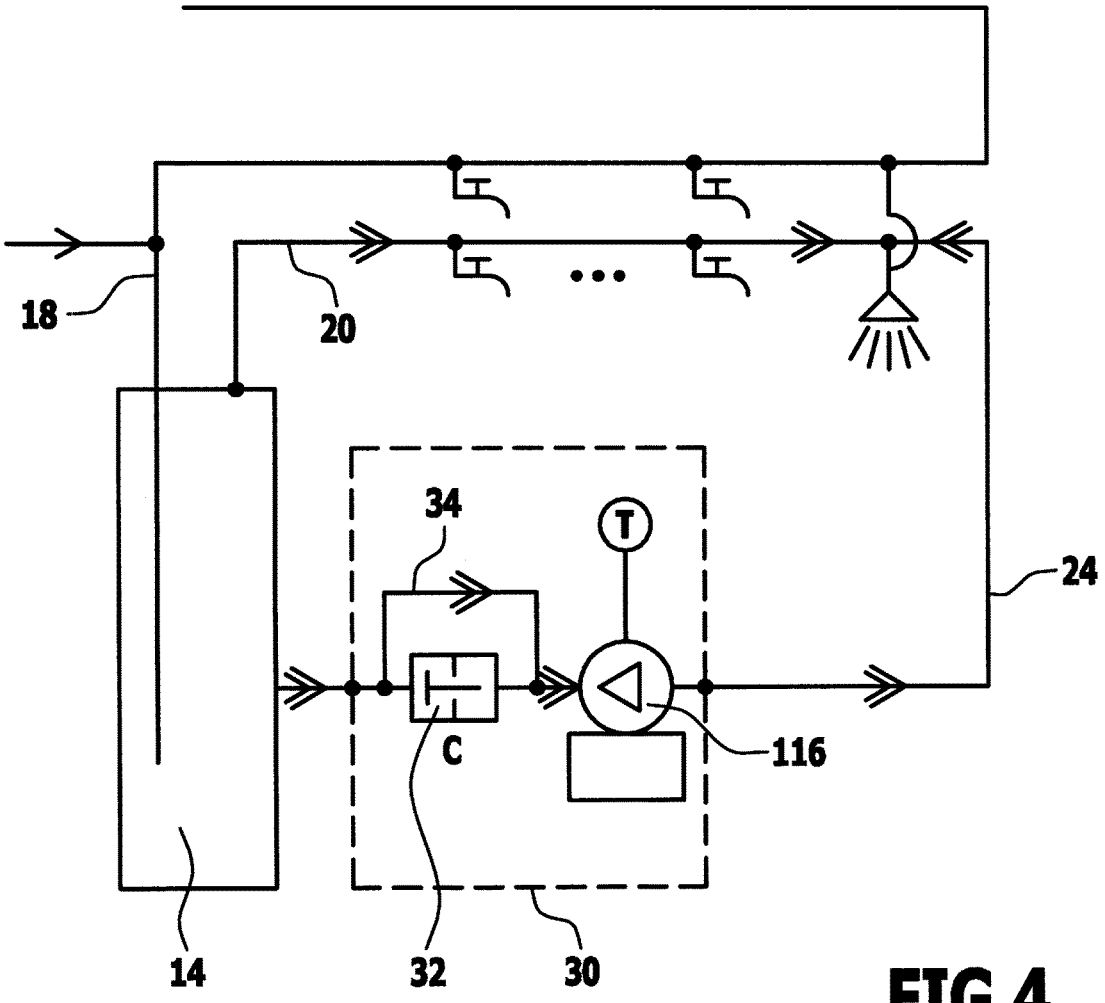
FIG. 4 shows the industrial water system according to FIG. 1 with water tapping, wherein the direction of flow is indicated when the check valve is closed.

If starting from the "recirculation state" according to FIG. 3 hot water is tapped at a tapping point such as tapping point 22*a*, the pressure on check valve 32 increases as a result of the opening in the hot water line 20 and the check valve closes. This is schematically shown in FIG. 4, wherein "C" indicates the closed state of the check valve 32.

For example, dynamic pressure is placed on the feed pump 116 based on a pumping heir of 1 m. The magnitude of the static pressure in the industrial water system 10 lies in the range between 30 m and 50 m, so water tapping of the hot water line 20 will certainly close check valve 32.

The design of the pump device 30 means elements of the pump device 30 can detect water tapping on the hot water line 20 both when the feed pump 116 is in operation and when the feed pump 116 is not in operation.

If water tapping takes place on the hot water line 20 starting from the "recirculation state" according to FIG. 3 in which the feed pump 116 is in operation and as a result closes the check valve 32, this changes the throughflow quantity of pumping medium (water) through the feed pump 116. This can be detected using the sensor device 46.

In principle, the throughflow quantity Q is proportional to the third root of a motor performance P of the electric motor 120; the motor performance P is the power consumption of the electric motor 120. The throughflow quantity Q if further proportional to the number of rotations n of the electric motor 120, in other words to the number of rotations n of the impeller 136 of the feed pump 116, which in turn corresponds to the number of rotations of the rotor 124 of the electric motor 120. In the event that the number of rotations n is known or in particular specified, the measurable motor performance P can be used to determine the throughflow quantity Q.

With regard to a method for the determination of the throughflow quantity of a liquid through a line with the help of a feed pump, reference is expressly made to DE 10 2007 054 313 A1 and DE 10 2013 109 134 A1.

In particular, there is a provision for a throughflow determination to be carried out at a constant number of rotations n. In order to do this, it is necessary to determine the point in the pumping curve at which the feed pump 116 is currently working.

Figure 5:
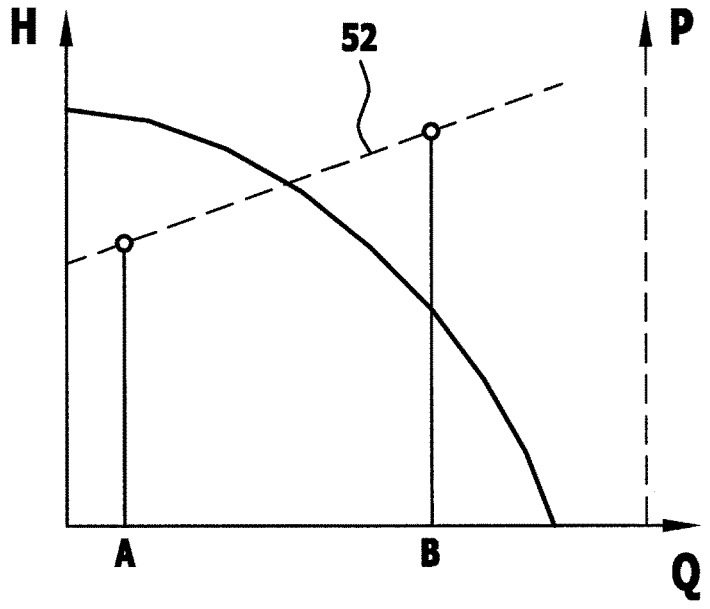
FIG. 5 shows a schematic representation of the link between the pumping height of a feed pump and the throughflow quantity through the feed pump and between the power consumption of an electric motor of the feed pump and the feed quantity.

In a first approximation, the pumping curve has a linear relationship (FIG. 5). The corresponding link is determined once and saved in a memory of the evaluation device 42. This means corresponding calibration data is provided that is saved in the feed pump by the factory 116.

For example, the motor performance P is determined by the sensor device 46 when the number of rotations n is specified. This is then "looked up" in the table saved in the evaluation device 42, indicating the current throughflow quantity Q.

When conventional high efficiency pumps are used as feed pumps 116, the power consumption generally increases in an almost linear manner by around 25% when the throughflow quantity is increased from 0 to the maximum when the number of rotations is constant.

The evaluation device 42 receives data from the sensor device 46 and monitors these. The evaluation device 42 in particular monitors the absolute value of the throughflow quantity and checks whether there is any change in the throughflow quantity Q in particular above a threshold. A corresponding significant change means tapping on the hot water line 20.

The method described above can be used to determine whether (and with the help of the timing element 50 when) water tapping on the hot water line 20 takes place when the feed pump 116 is in operation, in other words starting from the "recirculation state" according to FIG. 3.

FIG. 5 shows a schematic view of a pumping curve for the feed pump 116 indicating a pumping height H depending on the throughflow quantity Q. A constant number of rotations n is assumed.

The power consumption P (motor performance) is also shown. The corresponding data apply to a high efficiency pump.

The power consumption P increases as the pumping quantity Q increases (curve 52). FIG. 5 is a schematic view of two points; point B corresponds to a state in which the check valve 32 is open. Point A corresponds to a state with a low level of throughput in which the check valve 32 is closed. It should be noted that the assumption can be made that when hot water is tapped from the hot water line 20 when the feed pump 116 is running, this can generally not have any further positive throughput but rather a small negative throughput. The water supply generally provides pressure that is a factor of 30 to 50 higher than that which corresponds to the pressure difference of the feed pump 116. The assumption can therefore be made that the power consumption P at point A is actually lower than indicated in FIG. 5.

The link between power consumption and quantity pumped (throughflow quantity) can be identified, and tapping on the hot water line 20 can be identified using the feed pump 116 (by means of the evaluation device 42 and the sensor device 46) when the feed pump 116 is running.

In principle it is also possible for example in the case of performance-limited feed pumps for the number of rotations to be monitored and analysed instead of the power consumption (motor performance) P. Feed pumps 116 in a circulation system are generally operated with the number of rotations controlled as the range of performance is relatively low.

Figure 6:
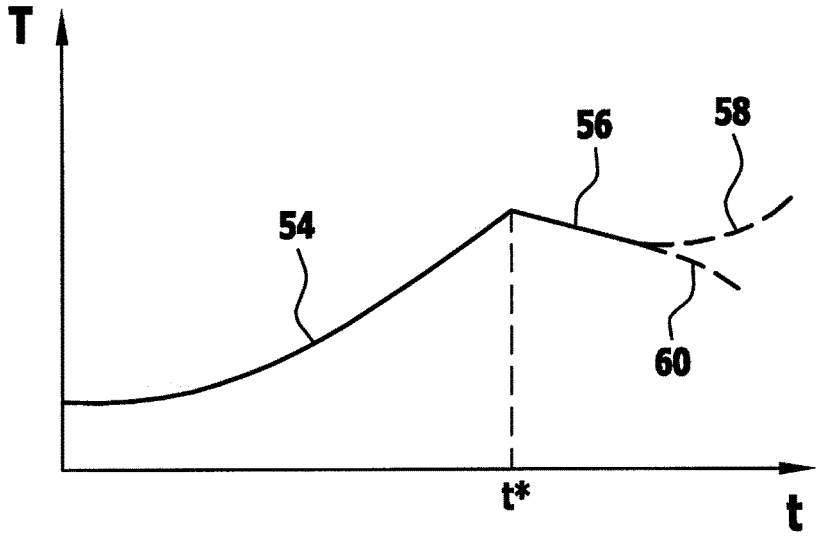
FIG. 6 shows a schematic representation of the time-bound nature of a temperature measured on a feed pump depending on "events" on the industrial water system.

FIG. 6 is a schematic representation of a possible progression of the temperature T over time which for example is measured using sensor 142. The curve 54 according to FIG. 6 corresponds to a temperature profile for when the feed pump 116 is in operation. The feed pump sucks hot water from the hot water tank 14 into the hot water line 20. This is heated as a result. The circulation line 24 is also heated. The water that reaches the feed pump 116 becomes increasingly hot over time until the entire line (hot water line 20, recirculation line 24) is hot and the temperature ceases to increase.

If for example at a time t* which is indicated in FIG. 6 tapping occurs on the hot water line 20, in other words for example a tap is turned on or a shower head is used, then check valve 32 is closed. Water then slowly flows backward through the feed pump 116. The check valve 32 can be bypassed via the "small" bypass line 34.

Water flows through the feed pump 116 as a result as the pump itself was pumping in the opposite direction shortly beforehand. This results in an inverted profile 56 for the temperature profile, wherein the increase is generally flatter than that of curve 54.

If the content of the line(s) between the hot water tank 14 and the feed pump, in other words is used up between the second connection 28 and the feed pump 116, then water flows out of the hot water tank 14.

This water then flows out of the hot water tank 14 through the bypass line 34 and into the feed pump 116. This is in turn expressed as temperature changes which can be detected by the temperature sensor 142. The temperature and the temperature changes depend on the position of a circulation input and in particular on the fill level of a boiler in the hot water provision device 12. If for example extensive showers are taking place, it is possible for the lower region of the hot water tank 14 to be cold and need to be heated up. If the hot water tank 14 is full, then hot water can once again be provided by said tank.

If the second connection 28 is positioned such that hot water flows from the hot water provision device 12 based on the current fill level, the temperature increases significantly (curve 58).

If it is primarily cold water that is entering the second connection 28 from the hot water provision device 12, then the temperature will fall significantly (curve 60 according to FIG. 6).

The temperature sensor 142 provides its data to the evaluation device 42 which determines the corresponding time-bound temperature profile.

If a significant change in temperature is detected by the evaluation device 42, particularly according to the curves 58 or 60, then this is an indication that water tapping is occurring or has occurred. Monitoring of the temperature changes by the evaluation device 42 can then be used to determine whether water tapping occurred. This water tapping can also be detected if the feed pump 116 is not in operation.

Even a minor change in temperature 56 compared to the changes in temperature 58, 60 can be detected. A temperature profile according to profile 56 is an indication of tapping.

According to the invention, water tapping is detected by means of "on-board means" in the feed pump 116 when the feed pump 116 is in operation and when it is not in operation. If the feed pump 116 is in operation, water tapping is in particular detected by a change in the throughflow quantity Q. If the feed pump is not in operation, due to a possible backflow of water from the hot water tank 14 through the bypass line 34 into the feed pump 116 water tapping is detected due to the relatively significant temperature changes.

The pump device 30 with the integrated sensor device with the temperature sensor 142 and the sensor device 46, regardless of the operating status of the feed pump 16 it is possible to detect whether there is water tapping or not. No sensors outside of the pump device 30 are needed for this. In particular, no temperature sensor is required on the hot water provision device 12. This means there are no cabling and connection costs.

The evaluation device 42 can therefore detect if there is water tapping on the hot water line 20 regardless of the operating status of the feed pump 116.

The timing element 50 can then determine when this water tapping occurs. In this way, the self-learning device 48 can determine a user pattern which is dependent on the time of the water tapping.

The user pattern determined in this way can in turn be used to control, set or adjust the operation of the feed pump 116. The user pattern determined is used such that in particular the feed pump is operated for a certain time (for example 15 minutes) before an expected tapping time in order to carry out recirculation. If a user carries out a tapping, he will receive constant hot water, in other words there will not be any cooled water in the hot water line 20.

Furthermore, the operation of the feed pump 116 can be switched off after a certain time (for example 15 minutes) after an expected interval in tapping as no further recirculation is needed.

The self-learning device 48 generates control data for the motor circuit 128 from the user patter in order to control, set or adjust the feed pump 116 based on the time.

The self-learning device 48 for example provides a control algorithm which has a 24-hour pattern and an overlapping 7-day pattern. This means a user pattern can be established over the entire week and used to control/set/adjust the feed pump 116 accordingly.

For example, a user pattern is allocated a finite life span by the self-learning device 48. If no use of this user pattern is detected, this user pattern is deactivated for the control/setting/adjustment of the feed pump 116. If for example the user pattern is not used over three cycles, a deactivation of this type will occur. If for example the user pattern is reused within three days, it is reactivated. For example, the life span is extended up to a maximum of 30 days, for example.

In this way it is possible to ensure that the feed pump 116 does not repeat singular events too often and therefore a basic pattern is adequately used.

The corresponding control of life span can also be used for the seven-day pattern. For example, user patterns may be different for each day and for example after a certain amount of time regular patterns develop for five working days wherein days six and seven follow other user patterns.

It is also possible for life spans of cycles and the length of operations of the feed pump 116 to be selectable in order to vary a "convenience factor". The longer the life cycles are and the longer a pump operation is, the less hot water is pumped into the hot water line 20 without recirculation; however, the energy consumption is then higher.

It can be favourable for the feed pump 116 to be put into operation as soon as a temperature change according to the curve 58 or 60 is detected because of the backflow of water into the feed pump 116. A temperature change according to profile 56 can also be detected and is an indication of tapping. This can be used to verify that water is actually (following the detection of a finite throughflow quantity during pump operation) flowing from the hot water tank 14 directly via the second connection 28 into the feed pump 116.

The feed pump 116 can also be operated until the tapping has stopped in order to determine the length of the water tapping. The results obtained in this way can be taken into account in the user pattern by the self-learning device 48.

It is also possible that no temperature change can be detected in the event of backflow of water from the hot water tank 14 via the second connection 28 and the feed pump 116, in particular if the line is exactly the same temperature as feed pump 116 upstream of pump 116. This is incidental in terms of the self-learning algorithm, however, as for example the user pattern can then be detected under more advantageous conditions.

The thermally insulated housing 150 enables a defined detection of the significant changes in temperature (curve 58 or 60) due to the backflow of hot water from the hot water tank 14 via the second connection 28 into the feed pump 116.

The solution according to the invention enables a self-learning method to be carried out in which a user pattern can be detected using the pump device 30 means. The user pattern can be detected regardless of whether the feed pump 116 is in operation or not. Simple training of the pump device 30 and the industrial water results in convenient and energy-saving operation. A user pattern can be detected and used without external sensors being provided for the pump device 30.

LIST OF REFERENCE NUMERALS

10 Industrial water system
12 Hot water provision device
14 Hot water tank
16 Boiler
18 Feeding device
20 Hot water line
**22*a*** Tapping point
**22*b*** Tapping point
**22*c*** Tapping point
24 Recirculation line
26 First connection
28 Second connection
30 Pump device
32 Check valve
34 Bypass line
36 Combination
38 First connection
40 Second connection
42 Evaluation device
44 Support
46 Sensor device
48 Self-learning device
50 Timing element
52 Curve
54 Curve
56 Profile
58 Curve
60 Curve
116 Feed pump
120 Electric motor
122 Stator
124 Rotor
126 Motor housing

128 Motor circuit
130 Switch housing
132 Bearing shell
134 Bearing body
136 Impeller
138 Rotational axis
140 Pumping chamber
142 Temperature sensor
144 Wall
146 Temperature sensor provision
150 Housing
151 Pump housing

The invention claimed is:

1. A pump device for arrangement on a recirculation line of an industrial water system, said pump device comprising a feed pump, a check valve and a bypass line for the check valve, wherein the bypass line is parallel to the check valve and wherein a combination of the check valve and bypass line is arranged in series with the feed pump, wherein:

a first connection is fluidly connected to the combination of the check valve and the bypass line, and the first connection connects the pump device through the combination of the check valve and the bypass line directly to a hot water provision device; and a second connection is fluidly connected to the feed pump, wherein the pump device is configured to cause a pumping medium to flow from the second connection to the first connection through the feed pump when the feed pump of the pump device is operated.

2. The pump device according to claim 1, wherein the check valve is arranged and configured to close in the event of water tapping on a hot water line on which the recirculation line is arranged.

3. The pump device according to claim 1, wherein the bypass line is arranged and configured such that a throughput of pumping medium occurs through the bypass line corresponding to a maximum of 15% of the throughput of pumping medium through the pumping device when the check valve is open and the feed pump is in operation.

4. The pump device according to claim 1, wherein the bypass line has a hydraulic cross-sectional area which is in a range of 5% to 15% of a hydraulic cross-sectional area of the recirculation line on which the pump device is arranged.

5. The pump device according to claim 1, wherein the pump device further comprises a sensor device and a microcontroller comprising an evaluation device connected to and configured to receive a signal from the sensor device, wherein the sensor device and the evaluation device are configured to detect when water is tapped out of a hot water line to which the recirculation line is connected.

6. The pump device according to claim 5, wherein the sensor device is integrated into the feed pump and is arranged within a housing of the feed pump.

7. The pump device according to claim 5, wherein the evaluation device is integrated into the feed pump and is arranged inside a housing of the feed pump and the evaluation device is either arranged on or connected to a support for a motor circuit of an electric motor of the feed pump.

8. The pump device according to claim 5, wherein the sensor device is arranged and configured and the evaluation device is configured to detect water tapping both when the feed pump is running and when the feed pump is not running.

9. The pump device according to claim 5, wherein the sensor device is arranged and configured and the evaluation device is configured such that when the feed pump is running, a change in a throughflow quantity ($\Delta Q$) of pumping medium through the feed pump or an absolute value of the throughflow quantity (Q) can be used to detect water tapping.

10. The pump device according to claim 9, wherein the sensor device comprises a sensor to determine a number of rotations (n) of a rotor of an electric motor of the feed pump or a sensor to determine a power consumption (P) of the electric motor, and wherein the evaluation device determines the absolute value of the throughflow quantity (Q) from the number of rotations (n) and a power consumption (P) of the electric motor.

11. The pump device according to claim 5, wherein the sensor device has at least one temperature sensor which is arranged inside the feed pump.

12. The pump device according to claim 11, wherein the evaluation device is configured to monitor temperature signals provided by the at least one temperature sensor and, in the event of a temperature change, the evaluation device is configured to generate a detection signal, which detection signal indicates the flow of water back from the hot water provision device through the bypass line and into the feed pump when the feed pump is not in operation.

13. The pump device according to claim 12, wherein the evaluation device is configured to generate a switching signal for the feed pump when the evaluation device generates the detection signal.

14. The pump device according to claim 12, wherein the microcontroller further comprises a self-learning device coupled to the evaluation device, the self-learning device configured to provide control signals to the feed pump for operation of the feed pump; on the basis of a user pattern determined using the sensor device and the evaluation device.

15. The pump device according to claim 14, wherein the self-learning device includes a timing element which is configured to determine one or more occurrence times of water tapping and the self-learning device is configured to save the one or more occurrence times accordingly, wherein control or setting or adjustment of the operation of the feed pump occurs based on the occurrence times saved.

16. The pump device according to claim 15, wherein activation of the feed pump occurs at a specific time interval before the saved occurrence times or the end of the operation of the feed pump occurs at a specific time interval after the saved occurrence times.

17. The pump device according to claim 1, wherein the feed pump has a thermally insulated housing.

18. An industrial water system comprising:

a hot water provision device, a hot water line connected to the hot water provision device and on which at least one tapping point is arranged, a recirculation line connected to the hot water line and which leads to the hot water provision device, and a pump device arranged on the recirculation line, said pump device comprising a feed pump, a check valve and a bypass line for the check valve, wherein the bypass line is parallel to the check valve and wherein a combination of the check valve and bypass line is arranged in series with the feed pump, wherein:

a first connection is fluidly connected to the combination of the check valve and the bypass line, and the first connection connects the pump device through the combination of the check valve and the bypass line directly to the hot water provision device; and a second connection is fluidly connected to the feed pump, wherein the pump device is configured to cause a pumping medium to flow from the second connection to the first connection through the feed pump when the feed pump of the pump device is operated.

* * * * *